United States Patent [19]

Hopkins et al.

[11] Patent Number: 4,719,454

[45] Date of Patent: Jan. 12, 1988

[54] PERSONAL ALARM

[75] Inventors: Harry C. Hopkins, Williamston, N.C.; Joseph K. Power, Alpine, Ala.

[73] Assignee: Hopkins International, Williamston, N.C.

[21] Appl. No.: 792,897

[22] Filed: Oct. 30, 1985

[51] Int. Cl.[4] ..... G08B 13/00

[52] U.S. Cl. ..... 340/574; 340/689

[58] Field of Search ..... 340/574, 689, 384 E, 340/693

[56] References Cited

U.S. PATENT DOCUMENTS

| | | | |
|---|---|---|---|
| 3,740,648 | 6/1973 | Grotjahn | 340/689 X |
| 4,151,520 | 4/1979 | Full | 340/574 X |
| 4,189,721 | 2/1980 | Doell | 340/574 X |
| 4,253,095 | 2/1981 | Schwarz et al. | 340/689 X |
| 4,335,377 | 6/1982 | Bostic | 340/574 X |
| 4,404,549 | 9/1983 | Berg | 340/574 |
| 4,520,351 | 5/1985 | Altman et al. | 340/574 |

*Primary Examiner*—Glen R. Swann, III
*Assistant Examiner*—Thomas J. Mullen, Jr.
*Attorney, Agent, or Firm*—Darby & Darby

[57] ABSTRACT

A portable personal alarm which has a small size and achieves high sound levels utilizes the overdriving of a miniature buzzer. In order to reduce the likelihood of damage to the buzzer and create a more terrifying and noticeable sound, the alarm tone is pulsed.

7 Claims, 3 Drawing Figures

PERSONAL ALARM

BACKGROUND OF THE INVENTION

This invention relates to alarm units and, more particularly, to portable alarm devices for personal use.

A large number of portable personal alarm devices have been devised in recent years in an effort to provide people with security against personal attack by criminal elements. Additionally, these devices can provide an effective means of signaling for help when a person is injured or incapacitated from non-criminal means. These devices fall into two basic categories.

One category of alarm device requires the user to carry a transmitter which sends an alarm signal to a remote receiver—for example, a police station or a nurse's station in a hospital. Examples of the transmitter type of personal alarm are disclosed in U.S. Pat. No. 4,189,721 of Doell. This first type of device suffers from the disadvantage that it requires that assistance be obtained only from people at the remote location. Thus, people who are closer to the user, and capable of more rapid response, may be totally unaware of the signal. Nevertheless, these devices have value in that the transmitters are generally light weight and small in size.

The second general type of personal alarm is a device which emits an audible signal when a person is in trouble, either due to natural accidental causes or criminal involvement. Examples of this second type of device include those disclosed in U.S. Pat. No. 4,158,197 of Takagaki, U.S. Pat. No. 4,151,520 of Full, and U.S. Pat. No. 4,520,351 of Altman et al. These devices require a size-sound level tradeoff. In particular, the greater the sound produced by the device, the larger the device usually is. Such large devices are cumbersome and owners are reluctant to carry them. Further, their physical size makes it difficult for the user to activate them in an emergency situation. For example, they may be stored in a woman's purse or a travel case and it would be necessary to remove the device from its case prior to activation. When smaller devices are used the sound level is generally of such a low level that they are relatively ineffective. Typically, criminal attacks do not occur when a person is in close proximity to others and there is little need to summon aid to a person in distress when he is in the near vicinity of other people.

Another difficulty with the bulky personal alarms, such as that in the Altman et al. patent, is that they are difficult to conceal. Therefore, during an attack a perpetrator can seize the alarm device and turn it off or destroy it before help is summoned. Thus, an easily disguised small package is preferred.

SUMMARY OF THE INVENTION

The present invention is directed to the provision of a small, but relatively loud portable personal alarm device.

In an illustrated embodiment of the invention the alarm device includes an alarm buzzer having a particular voltage rating and circuit means for applying a voltage to the buzzer which exceeds its rated voltage level. The present inventors have found that higher sound levels can be obtained from miniature buzzer devices when they are over-driven by a signal which greatly exceeds their rating. While under normal uses of a buzzer it would be unwise to drive it with a voltage beyond its rated level, in an emergency situation where the device is called upon to operate only a few times over its useful life, it is acceptable to operate the device beyond its rated level as a means of achieving or generating an extremely high sound level as an emergency signal.

In a preferred embodiment of the invention a pulse-generating circuit is provided for overdriving the alarm buzzer. This pulse generator circuit has two significant effects. The first is to change the tone of the buzzer, since it has been found that a repetitive beeping sound has a more terrifying effect and would attract more attention than a continuous tone. In addition, by driving the buzzer with a pulse signal the mean or average energy delivered to the buzzer is significantly reduced, thus prolonging its ability to withstand an over-voltage for a longer period of time. In one device according to the present invention which has been found to be particularly successful, a three volt buzzer has been driven by a nine volt DC level or nine volt pulses that occur at the rate of 180 pulses per minute or 3 Hz. Such a buzzer has produced sound levels of nearly 90 decibels (db) measured three meters from the device.

By utilizing an overdriven miniature buzzer, the overall size of the alarm device can be made less than 3 cubic inches. Such a device is convenient and light weight, thus promoting its use. In addition, because of its relatively small size, it can be concealed on the person or user or made to appear to be some other item which the user would normally have, for example, a key case.

In a further preferred embodiment of the invention the personal alarm is equipped with a gravity switch such that it will operate whenever its generally vertical orientation is changed. In such a case, the alarm could be carried in an inside coat pocket or a shirt pocket. Consequently, it would remain vertical whether the user was standing or sitting. However, if for some reason the user was in a prone position, the gravity switch would operate the alarm, sending out a signal. For example, if an elderly patient were to faint or if a person were to be attacked by criminal elements and ended up in a prone position, it would not be necessary for them to personally activate the alarm. Rather, it would operate automatically.

In a still further embodiment of the invention the device is provided with a number of switches which make it difficult for an attacker to determine the correct procedure for shutting off the alarm. Further, it can be enclosed in a high impact plastics material case which makes it difficult for the device to be destroyed.

In a still further preferred embodiment of the invention the device can be equipped with a miniature transmitter which will operate in conjunction with the local audible alarm so that the people in the vicinity, as well as people at designated remote receivers, will be notified of the emergency condition.

BRIEF DESCRIPTION OF THE DRAWINGS

The foregoing and other features of the present invention will become more readily apparent from the following detailed description and drawings of illustrative embodiments of the invention in which.

DESCRIPTION OF ILLUSTRATIVE EMBODIMENTS

Figure 1:
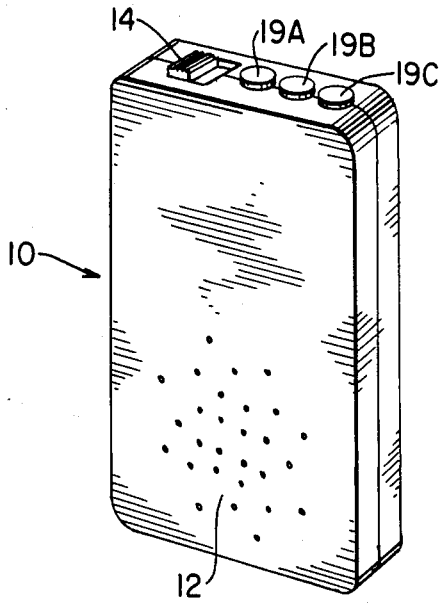
FIG. 1 is a perspective view of a key case in which a personal alarm according to the present invention is enclosed.

In FIG. 1 there is a perspective view of a small device which has the appearance of a key case, except for a group of buttons along one edge and openings in the side wall of the case. This case is used to store the personal alarm device and is typically about three inches long, about one and one-half inches across, and about one half inch in depth, i.e. 2.25 cubic inches in volume. It is preferably made of a high-impact resistant plastics material, e.g. polyvinylidene fluoride-acrylonitrile butadiene styrene, so that it is relatively difficult to damage.

Since the device has such a small size and is relatively light in weight, i.e. less than 6 ounces, it can be worn in the inside pocket of a coat, a shirt pocket, a woman's purse or other convenient location. However, it is preferable that it be worn or carried adjacent the upper body of the user since that portion of the body normally remains vertical during daily activities.

Located within the package of FIG. 1 is a buzzer, a battery and an electronic circuit. In a preferred embodiment, the buzzer is rated at 3 volts and the battery is 9 volts. Thus, in its most simple form the circuit can be a switch connecting the nine-volt battery to the buzzer so as to drive the buzzer with a voltage beyond its rated capacity. It has been found that when this is done and a miniature buzzer such as Model CLC-238 manufactured by Kobshi Electric Co., Hong Kong, is used, the buzzer will produce an extremely high noise level—for example, approximately 90 db. To allow this high noise level to escape the package 10, perforations 12 are provided in the package. Connection of the battery to the speaker can be by means of a slide switch 14 or a similar push button switch.

The simple arrangement is effective for producing a high-frequency single-tone sound. However, it is has been found that a more effective signal, in terms of warding off an attacker and summoning help, has an approximately 3 Hz intermittent operation or beeping. The circuit shown in FIG. 2 is utilized to achieve this type of sound.

Figure 2:
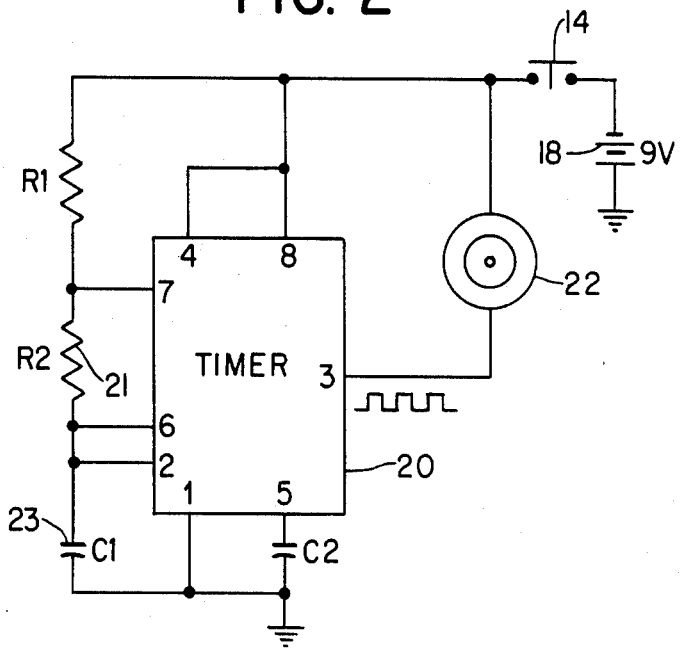
FIG. 2 is a circuit diagram of an illustrative embodiment of the invention which creates a beeping alarm signal.

In the circuit of FIG. 2, an integrated circuit timer 20 produces 9 volt pulses which are coupled to the buzzer 22. This circuit may be a Motorola Model NE-555. By means of resistor or 21 and capacitor 23, the frequency of the timer and the repetition rate of the output pulses can be varied if needed. Typically the timer can be set to generate fifty percent duty cycle, square wave pulses. As a result the total energy supplied to the buzzer is half that of a continuous 9 volt level. Therefore, even though buzzer 22 is being overdriven, the tendency to destroy the buzzer is greatly reduced through use of the pulsing circuit, as opposed to a direct DC connection to the buzzer.

Figure 3:
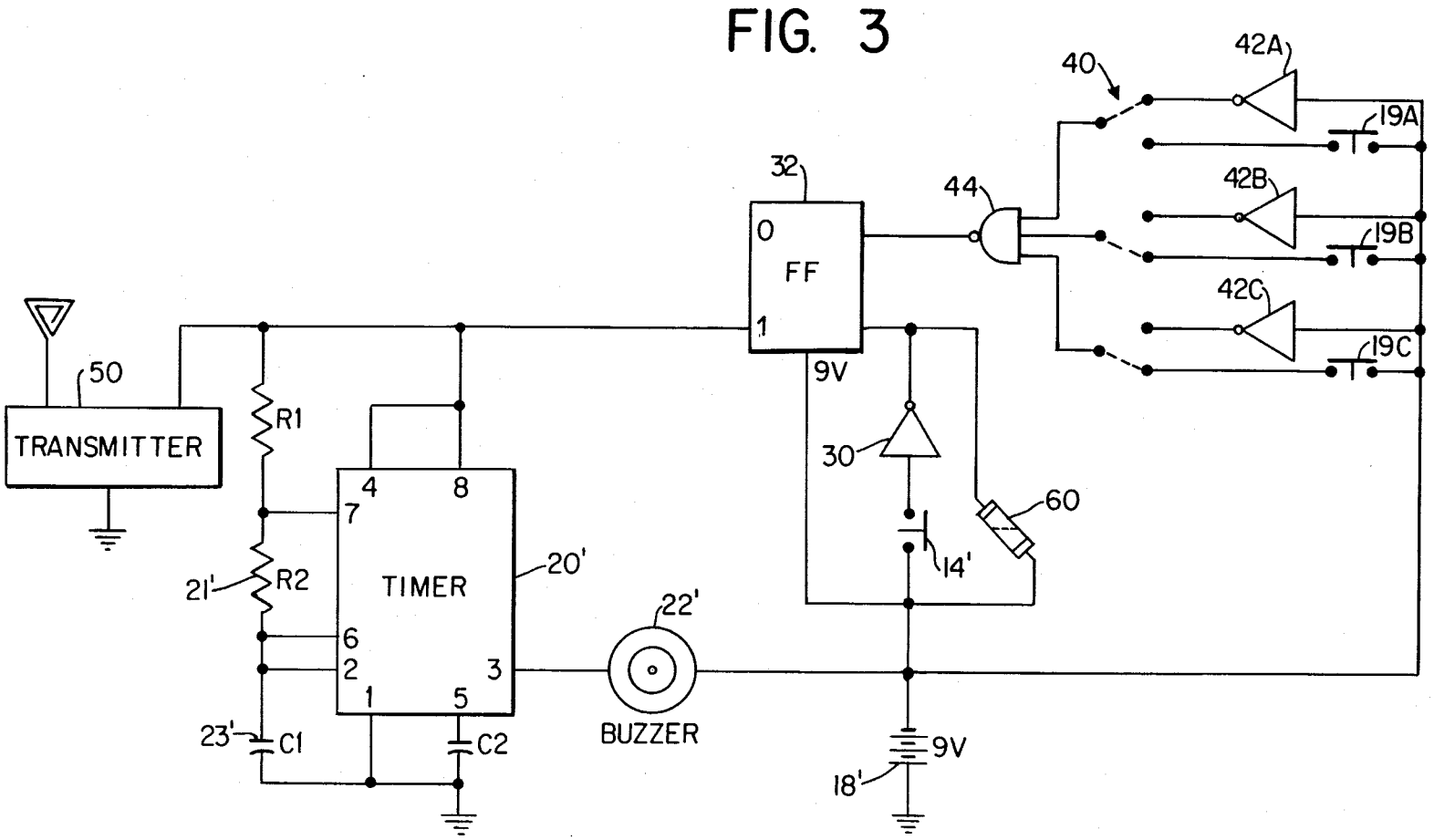
FIG. 3 is a circuit diagram of the present invention including a gravity switch, combination deactivator switches and an alarm transmitter.

The circuit shown in FIG. 3 is a more elaborate arrangement for the personal alarm of the present invention. Similar elements in this circuit which are the same as in FIG. 2 have been given the same reference numbers, but have been marked with a prime.

In the arrangement in FIG. 3 one side of the buzzer 22' is connected directly to the positive terminal of the 9 volt battery 18'. In addition, the connection across switch 14' to the timer 20' has been broken in the circuit of FIG. 3. Instead, operation of switch 14' produces a signal on inverter 30 which sets latch or flip-flop circuit 32 such that a voltage level sufficient to drive the timer 20' is created. In the FIG. 2 arrangement the alarm is on only so long as switch 14 was held in place. However, with the arrangement in FIG. 3, switch 14' can be depressed and then released, but the alarm will continue to sound. This occurs because the signal applied to inverter 30 causes latch circuit 32 to apply voltage to the timer from battery 18', without the need to pass through switch 14'.

In order to turn off the alarm it is necessary to reset the latch or flip-flop circuit 32. This is accomplished by depressing the proper combination of buttons 19A, 19B or 19C shown in FIG. 1. The combination of buttons which will deactivate the buzzer depends on the internal wiring of the deactivation circuit 40. In particular, inverters 42*a*, 42*b* and 42*c* provide positive signals indicating that switches 19A, B and C have been deactivated. By making appropriate connection between either the input or the output of inverters 42 and AND gate 44, the unit can be prewired for deactivation of latch circuit 32 by a particular combination of switches. As shown by dotted lines in circuit 40, this particular circuit has been set up to deactivate latch 32 whenever button 19A is pushed and buttons 19B and C are not pushed. However, any of seven other possible combinations can be wired into the device to create the code for deactivating latch circuit 32.

There are actually eight possible combinations of codes with three buttons, but the case where none of the buttons is depressed has to be reserved for normal operating conditions. Should an additional button be provided the number of combinations available increases to fifteen. Regardless of the combination selected, when the proper combination of buttons is pushed, AND-gate 44 causes latch flip-flop 32 to reset, thus removing power from the timer and ceasing the activation of buzzer 22'.

In operation, activation of switch 14' will cause the buzzer to produce a loud pulsing noise which will notify persons in the vicinity that the user is in some sort of trouble. However, in situations such as are found in a nursing home, those persons likely to be in the vicinity of the user may themselves be incapable of providing or calling for assistance. Thus provision is made in the unit for a small transmitter 50. This transmitter can send an alarm signal to a receiver which, for example, could be located at a nurse's station. Thus, anyone in the vicinity of the person in distress, as well as anyone at a nurse's station, will be notified of the difficulty.

Even though the present invention as described so far is small and simple to activate, in certain situations it may be difficult for the person to activate the device. For example a sudden attack by a criminal may not leave sufficient time to respond by activating the alarm. Also, an elderly person may become ill rapidly and be unable to activate the alarm. As a result, a gravity switch 60 is provided in parallel with push button switch 14'. The gravity switch may take the form of two spaced apart contacts in a vessel containing a liquid conductor, such as mercury. As long as the gravity switch remains in a generally vertical position, the mercury cannot bridge the distance between the two contacts. However, if a person should be in a prone position the mercury will bridge the contacts and will deliver a nine volt signal through inverter 30 to the latching circuit 32. Such a gravity switch can be of the general type disclosed in U.S. Pat. No. 3,594,748 of Grotjahn.

In utilizing the present invention a user has the ability to activate the alarm by depressing switch 14. In addition, by lying in a prone position or by otherwise changing the position of the device, it will also be activated. Once activated, the latch circuit 32 causes the alarm to continue to operate until it is turned off or until the battery runs down. In order to turn it off, the proper code of push buttons must be depressed. Thus, if the person is under attack the perpetrator may be frustrated in attempting to turn off the device because he does not know the code and there are a significant number of possible codes that have to be tried before it can be turned off. In addition, the case is made of high impact plastics material and it would be difficult for the perpetrator to destroy the alarm. Even if the attack is so rapid that the user does not have sufficient time to operate the alarm, he can operate it automatically by assuming a prone position. Further, the small size of the device makes it difficult for an attacker to determine the location of the loud noise.

While the present invention has been particularly shown and described with reference to a preferred embodiment thereof, it will be understood by those skilled in the art that there are changes in form and details that may be made therein without departing from the spirit and scope of the invention.

We claim:

1. A portable alarm device comprising:

a miniature audio generating device having maximum recommended continuous voltage and power ratings;

a source of voltage at least twice as great as the maximum voltage rating;

a timer circuit means connectable to said source of voltage for periodically generating voltage pulses of substantially the same value as said source of voltage when connected thereto, and applying said pulses to said audio generating device so as to cause said audio generating device to operate and produce a loud sound, said pulses having a repetition rate and width such that the energy delivered to the audio generating device exceeds the maximum continuous power rating; and means for connecting said timer circuit means to said source of voltage, said means for connecting including a latch circuit means for causing said source of voltage to be connected to said timer circuit means whenever the latch circuit means is set and causing the removal of such connection whenever it is reset, a first switch means for setting said latch circuit means, and a second switch means for resetting said latch circuit means, said latch circuit being resettable in operation only by means of said second switch means.

2. A portable alarm device as claimed in claim 1 wherein said miniature audio generating device is a miniature buzzer.

3. A portable alarm device as claimed in claim 2 wherein said buzzer has a voltage rating of approximately three volts and said source of voltage has a voltage of approximately nine volts.

4. A portable alarm device as claimed in claim 1 wherein the pulses of the timer circuit means are generated at the rate of 3 Hz with 50% duty cycle.

5. A portable alarm device as claimed in claim 1 further including a radio frequency transmitter means activated by said means for connecting such that an alarm signal is sent to a remote location wherever the audio generating device is activated.

6. A portable alarm device as claimed in claim 1 wherein said second switch means comprises a plurality of third activatable switch means, a logic circuit for producing an output only when preselected ones of said plurality of third activatable switch means are activated, the output of said logic means resetting said latch circuit means.

7. A portable alarm device as claimed in claim 6 wherein said means for connecting includes a gravity switch that is activated when the orientation of the device is changed, activation of said gravity switch being sufficient to cause said audio generating device to operate.

* * * * *